US006610966B2

(12) United States Patent
Julius

(10) Patent No.: US 6,610,966 B2
(45) **Date of Patent: *Aug. 26, 2003**

(54) HOLDER FOR A DISPENSER PACKAGE

(75) Inventor: Robert P. Julius, Greenwich, CT (US)

(73) Assignee: Nice-Pak Products, Inc., Orangeburg, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/179,000

(22) Filed: Jun. 25, 2002

(65) Prior Publication Data

US 2003/0024919 A1 Feb. 6, 2003

Related U.S. Application Data

(62) Division of application No. 09/575,300, filed on May 19, 2000, now Pat. No. 6,431,360.

(51) Int. Cl.[7] ..... A47K 7/00; A47K 10/24; B65D 25/52; B65D 81/18

(52) U.S. Cl. ..... 219/386; 219/385; 222/146.5

(58) Field of Search ..... 219/385, 386, 219/521; 222/146.5

(56) References Cited

U.S. PATENT DOCUMENTS 5,697,577 A * 12/1997 Ogden ..... 242/598.6

6,331,696 B1 * 12/2001 Nakamura et al. ..... 219/386

FOREIGN PATENT DOCUMENTS

| | | | |
|---|---|---|---|
| JP | 08089436 | * | 4/1996 |
| JP | 08117137 | * | 5/1996 |
| JP | 08133344 | * | 5/1996 |
| JP | 2000333871 | * | 12/2000 |

* cited by examiner

*Primary Examiner*—Joseph Pelham
(74) *Attorney, Agent, or Firm*—Lerner, David, Littenberg, Krumholz & Mentlik, LLP

(57) ABSTRACT

A holder for a dispenser package having a resealable cap assembly with an outer perimeter includes a front wall, a rear wall and a bottom wall interconnecting lower ends of the front and rear walls, the front, rear and bottom walls defining a receiving area for the dispenser package, the front wall including an aperture defined by inner peripheral edges of the front wall. The holder also includes a heating element in thermal communication with at least one of the front, rear and bottom walls, a power source connected with the heating element, and at least one actuator provided at the inner peripheral edges of the front wall aperture, the at least one actuator being in communication with the heating element. The at least one actuator is movable between a first position for activating the heating element and a second position for deactivating the heating element.

9 Claims, 17 Drawing Sheets

HOLDER FOR A DISPENSER PACKAGE

CROSS REFERENCE TO RELATED APPLICATIONS

The present application is a divisional of application Ser. No. 09/575,300 filed May 19, 2000, now U.S. Pat. No. 6,431,360, the disclosure of which is incorporated by reference herein.

BACKGROUND OF THE INVENTION

The present invention is generally directed to dispenser packages that hold sheets, towels, towelettes, tissues, napkins or wipes and is particularly directed to a holder used to secure such dispenser packages.

Items such as sheets, towels, towelettes, tissues, napkins and wipes are frequently used by individuals for personal hygiene. There have been many efforts directed to providing convenient packages and/or dispensers for such items. For example, U.S. Pat. Nos. 2,278,011; 2,564,997; 5,065,970 and 5,332,138 all disclose tissue containers that may be secured to a sun visor of an automobile. U.S. Pat. No. 2,818,318 discloses a tissue holder that is attachable to the edge of a table, and U.S. Pat. No. 3,826,407 discloses a tissue dispenser that is attachable to an individual's wrist.

In many instances, an individual may desire to use a moist tissue or towelette for personal hygiene, cosmetic purposes, household cleaning applications and the like. In response to this demand, a wide variety of moisture-impermeable packages have been developed for storing moisture-impregnated items. U.S. Pat. Nos. 3,780,908; 3,836,044; and 3,841,466 disclose such packages. However, the packages disclosed in the above-mentioned patents provide for bulk packaging of moisture-impregnated towels. As a result, these packages cannot be easily attached to another object, such as a sun visor or the edge of a table.

In view of the above problems, there have been many efforts directed to providing user-friendly dispenser packages. For example, commonly assigned U.S. Pat. Nos. 4,156,493 and 4,185,754, the disclosures of which are hereby incorporated by reference herein, teach hermetically-sealed packages that have recloseable covers. In certain preferred embodiments, the cover may be opened for removing one or more moisture-impregnated towels, and then reclosed to keep the remaining towels moist. The packages are typically made of one or more sheets of a flexible material such as vinyl or foil. As a result, the packages tend to collapse as the towels are removed.

In many instances, the packages disclosed in the '493 and '754 patents are secured in holders. When these packages are placed in a holder, the holder may exert forces on the flexible material portion of the package, thereby making it difficult to remove moist towels. In addition, as towels are emptied from the package, the package may fall out of the holder and/or move away from the dispensing opening in the holder, thereby making it extremely difficult to access the towels remaining in the package.

Thus, there is a need for a holder for a dispenser package that both reliably secures the package and enables the towels packaged therein to be easily dispensed from the package. There is also a need for a holder that maintains the dispenser package in place relative to the holder as the towels are depleted from the package. There is also a need for a holder having a design that facilitates replacing a depleted dispenser package with a refill package.

SUMMARY OF THE INVENTION

In certain preferred embodiments of the present invention, a combination preferably includes a dispenser package and a holder for securing the dispenser package. The dispenser package is preferably replaceable so that when the towels packed therein have been dispensed, a refill package may be secured to the holder. The holder may include a stand alone item capable of holding the dispenser package atop a surface, such as a top surface of a table. In other embodiments, the holder may be securable to an edge, such as the edge of a sun visor of an automobile, the edge of a table or a high chair. In still other embodiments, the holder may be securable to a belt or apron worn by an individual. The holder may also be permanently securable to a wall or table top using one or more fasteners such as screws, nails or suction cups.

The dispenser package is preferably made of one or more sheets of flexible material, such as vinyl film, foil or any other flexible material that may be permanently sealed to provide a hermetically sealed container. The flexible material desirably has an opening extending therethrough. The opening is preferably made before the dispenser package is formed. The opening in the flexible material is preferably of sufficient size and shape to allow one or more items, such as moistened towels to be dispensed from the package. The dispenser package may collapse as the towels are dispensed from the package. The package is preferably adapted for holding items such as napkins, sheets, tissues, wipes, towels and/or towelettes (hereinafter commonly referred to as "towels") The towels are preferably interleaved with one another so that as a first towel is removed from the package, the leading edge of a second or subsequent towel is drawn through the package opening. As mentioned above, the dispenser package is preferably hermetically sealed so that the towels stored in the package may be maintained in a moistened condition.

A resealable cap assembly may cover the opening in the flexible material. The resealable cap desirably traps moisture within the package for maintaining the towels in a moist condition. The resealable cap also preferably maintains the moisture present in the leading edge of any towels projecting through the package opening. The resealable cap assembly is desirably attached to an exterior and/or interior surface of the flexible material. In certain preferred embodiments, the resealable cap assembly includes a collar that surrounds the opening in the package. The collar may be attached to the exterior and/or interior surface of the flexible material. The collar may also be sandwiched between exterior and interior layers of flexible material. The collar may be attached using an ultrasonic seal, a heat seal, glue, an epoxy, such as a hot melt epoxy, or an adhesive. The resealable cap assembly may include a sealing flange projecting upwardly from the collar and away from the dispenser package. The sealing flange may be integrally formed with the collar. In one preferred embodiment, the sealing flange and collar form a single piece of integrally molded plastic. The resealable cap assembly may also include a reclosable cap that is engagable with an upper surface of the sealing flange to selectively close the opening in the package, thereby retaining moisture within the package. In certain embodiments, the reclosable cap is hingedly connected to the sealing flange. As a result, the reclosable cap may be repeatedly opened for dispensing one or more items from the package, and then reclosed to retain the moisture within the package. The reclosable cap may have an outer perimeter with one or more notches or gripping elements provided thereon so that the cap may be easily engaged for moving the cap between the open and closed positions. In one particular preferred embodiment, the gripping elements include one or more projections extending beyond the perimeter of the cap.

The holder preferably includes a front wall having an upper end and a lower end, a rear wall having a upper end and a lower end, and an bottom wall extending between and interconnecting the lower ends of the front and rear walls. In certain preferred embodiments, the holder is substantially U-shaped. The front, rear and bottom walls preferably form a receiving area for the flexible dispenser package described above. The dimensions of the holder, and particularly the dimensions of the package receiving area, may be modified depending upon the dimensions of the package being received in the holder. The holder desirably has an open end, adjacent the upper end of the front and rear walls and remote from the bottom wall of the holder.

In other preferred embodiments, the holder may also include one or more side walls, each side wall extending between the front and rear walls of the holder. The one or more side walls of the holder may increase the structural integrity of the holder and cover the sealed ends of a dispenser package so that the sealed ends are not exposed. Thus, the one or more side walls desirably cover and protect the sealed ends of the dispenser package, thereby improving the aesthetic appearance of the combination dispenser package and holder. The side walls may also improve the structural integrity of the holder.

The front wall of the holder desirably has outer peripheral edges and an aperture that is spaced inwardly of the outer peripheral edges. The front wall aperture is preferably defined by inner peripheral edges of the front wall that are spaced inwardly from the outer peripheral edges of the front wall.

In certain preferred embodiments, the holder may be attached to a stationary object so that only one hand in needed to open the reclosable cap and remove one or more towels from the package. The holder may be secured to a stationary object through a clip that is attachable to or integrally connected to the holder. The clip is preferably connected to the rear wall of the holder, at a location remote from the front wall of the holder. The clip preferably enables the holder to be secured to an edge surface, such as the edge of a vehicle sun visor, the edge of a table, a baby's high chair, a work belt and/or an apron. The combination of the holder and the clip may form a substantially S-shaped structure, whereby the clip has an open end that faces away from the open end of the holder. The clip may be detachable from the holder so that a wide variety of clips having different sizes may be attached to the holder. The design, style or shape of the clip attachable to the holder may be modified so that the holder can be attached to different types of surfaces or structures. For example, a clip having an opening facing in a downward direction may be replaced by a clip having a right-hand opening. Clips having different sizes may also be attached to the holder. As a result, the holder may be modified to be attached to visors, tables, edge surface, etc. having different sizes.

In operation, a dispenser package may be secured to the holder by sliding a main body portion of the package between the front and rear walls of the holder. A portion of the resealable cap assembly is preferably passed through the aperture in the front wall so that the resealable cap assembly engages the inner peripheral edges of the front wall aperture. As a result, the resealable cap assembly forms a press-fit, slot-in-groove, or frictional engagement with the inner peripheral edges of the front wall aperture for securing the dispenser package to the holder.

The dimensions of the front wall aperture are preferably substantially similar to the dimensions of the surface area of the resealable cap assembly that engages the front wall aperture. As a result, the resealable cap assembly engages the inner peripheral edges of the front wall aperture when the resealable cap assembly is attached to the front wall aperture. Once the dispenser package has been secured to the holder, the reclosable cap may be opened for dispensing one or more towels from the package.

Although the present invention is not limited by any particular theory of operation, it is believed that securing the dispenser package to the holder through the engagement of the resealable cap assembly with the front wall aperture, the flexible material portion of the dispenser package is not compressed by the holder, thereby enabling packaged items to be easily dispensed from the dispenser package. This is an improvement over prior art holders that typically apply a pinching force to the flexible material portion of the dispenser package, thereby making it more difficult to dispense towels from the package. The present invention also holds the opening of the dispenser package against the opening in the holder, thereby avoiding the likelihood that the package will move away from the front wall aperture as the stock of towels are depleted.

In certain preferred embodiments, the resealable cap assembly may include surfaces having one or more peripheral edges engagable with the inner peripheral edges of the front wall aperture for securing the resealable cap assembly to the holder. The one or more inner peripheral edges of the holder may have one or more grooves extending between upper and lower ends of the front wall of the holder. The peripheral edges of the resealable cap assembly are preferably captured within the grooves of the front wall aperture for securing the resealable cap assembly to the holder. The sides of the collar of the resealable cap assembly may taper inwardly between the upper and lower ends of the collar. The tapered surfaces facilitate sliding the peripheral edges of the collar into the grooves formed in the front wall aperture. The cap assembly may also include attachment flanges that project above and beyond the lateral side edges of the collar. The peripheral edges of the collar may also be taper outwardly between top and bottom surfaces of the collar.

The holder may be connected to a heating unit that selectively heats the walls of the holder and any dispenser package secured to the holder. Upon activation, the heating unit heats the walls of the holder which, in turn, heats the towels within the dispenser package to a desired temperature (e.g., body temperature).

The holder may be mounted atop a stand or base which includes the heating unit. The base preferably includes one or more heating coils that may be activated for generating heat. The heating coils desirably extend adjacent the front, rear and/or bottom walls of the holder. As a result, activated heating coils generate heat that is thermally conducted by the walls of the holder. In turn, the heat conducted by the walls of the holder is transferred to the dispenser package and the towels packaged therein.

In certain preferred embodiments, the inner peripheral edges of the front wall aperture have one or more actuators in communication with the inner peripheral edges. The one or more actuators are preferably movable between a first position and a second position. When the actuators are in the first position, a signal is sent to the heating unit to activate the heating coils. When the actuators are in the second position, a signal is sent to the heating unit to deactivate the heating coils. In certain preferred embodiments, when the dispenser package is secured to the holder, the outer perimeter of the resealable cap assembly desirably engages the one or more actuator elements for activating the heating unit. The heating unit preferably includes one or more controllers for turning the heating unit on and off and for controlling the heating level of the heating unit. In one particular preferred embodiment, a rotatable knob is provided that is capable of moving between the following positions: on, off, low, medium and high.

In yet other preferred embodiments, the inner peripheral edges of the front wall aperture of the holder may include one or more internally extending projections, and the outer perimeter of the resealing cap assembly preferably has one or more depressions that are sized and shaped for receiving the one or more internally extending projections. The one or more depressions in the cap assembly may be provided in the outer perimeter of the sealing flange. When a dispenser package is secured within the holder, the male end projections of the front wall aperture mesh with the depressions on the outer perimeter of the cap assembly to hold the cap assembly to the holder. In other preferred embodiments, the inner peripheral edges of the front wall aperture may include one or more depressions and the outer perimeter of the cap assembly may include one or more projections sized and shaped to fit within the one or more depressions in the inner peripheral edges of the front wall aperture.

In still other further preferred embodiments, a holder for a dispenser package having a resealable cap assembly with an outer perimeter includes a front wall, a rear wall and a bottom wall interconnecting lower ends of the front and rear walls. The front, rear and bottom walls of the holder define a receiving area for the dispenser package. The front wall desirably includes an aperture defined by inner peripheral edges of the front wall. The holder includes a heating element in thermal communication with at least one of the front, rear and/or bottom walls. The holder also preferably includes at least one actuator provided at the inner peripheral edges of the front wall aperture and in communication with the heating element. The at least one actuator is movable between a first position in which the heating element is activated and a second position in which the heating element is deactivated. In operation, the outer perimeter of the resealable cap assembly is preferably engagable with the inner peripheral edges of the front wall aperture for securing the dispenser package to the holder. When the cap assembly is secured to the holder, the outer perimeter of the cap assembly engages at least one actuator for urging the actuator into a first position for activating the heating element.

In yet further preferred embodiments of the present invention, the front wall of a holder may include a hinge so that the front wall may be swung between open and closed positions. As such, the front wall may be swung from a closed position to an open position for loading and/or removing a dispenser package from the holder. After a dispenser package has been placed in the holder, the front wall may be swung back to the closed position shown in FIG. 32. Referring to FIG. 33, in certain preferred embodiments, the holder also includes a resilient element, such as a spring, adjacent the front wall hinge that normally urges the front wall to move back to the closed position. As a result, an operator can merely release the front wall when the front wall is in the opened position and the front wall will snap back to the closed position.

DETAILED DESCRIPTION OF PREFERRED EMBODIMENTS

Figure 1:
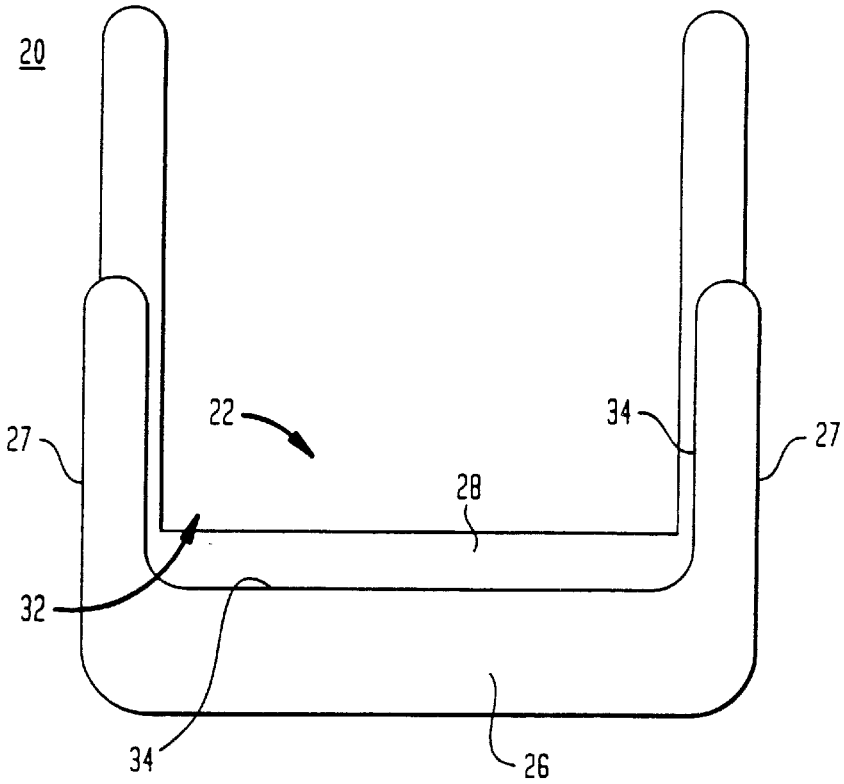
FIG. 1 shows a front view of a holder for a dispenser package, in accordance with certain preferred embodiments of the present invention.
Figure 2:
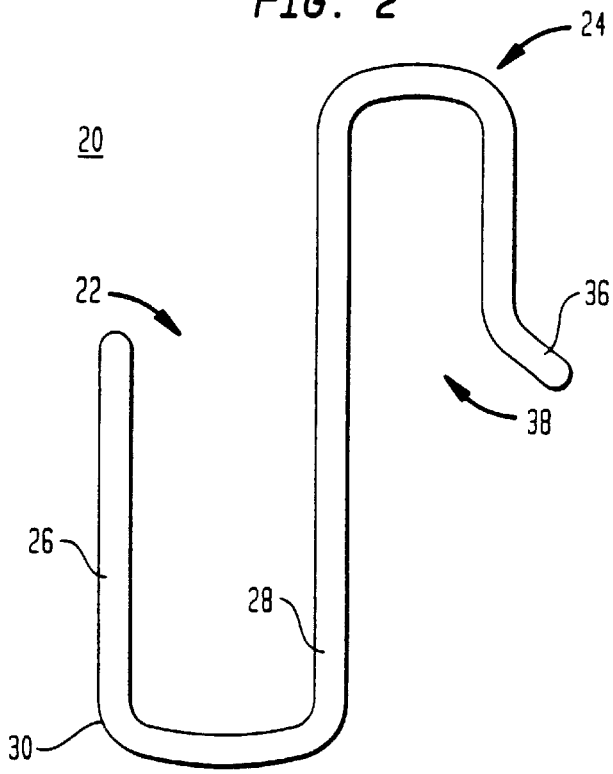
FIG. 2 shows a right side view of the holder of FIG. 1, including a clip integrally connected with a rear wall of the holder.

FIGS. 1 and 2 show a holder 20 for a dispenser package, in accordance with certain preferred embodiments of the present invention. The holder 20 includes a package receiving area 22 for a dispenser package and a clip 24 for securing the holder to another element, such as an edge of a surface, a belt or an apron. The holder 20 includes a front wall 26, a rear wall 28 and a bottom wall 30 that interconnects lower ends of the front and rear walls 26, 28. The front, rear and bottom walls preferably surround the package receiving area 22 of the holder. Referring to FIG. 1, the front wall 26 preferably includes outer peripheral edges 27 and an aperture 32 spaced inwardly of the outer peripheral edges. The aperture 32 is defined by inner peripheral edges 34 of the front wall 26 that are spaced inwardly from the outer peripheral edges. The clip 24 attached to the holder 20 is preferably integrally connected to an upper end of the rear wall 28. In certain preferred embodiments, the holder 20 is preferably substantially S-shaped so that an open end of the package receiving area 22 faces an open end of clip 24. Clip 24 desirably includes an attachment guide 36 that may be angled relative to rear wall 28 so that holder 20 may be readily attached to an edge of a surface.

Figure 3A:
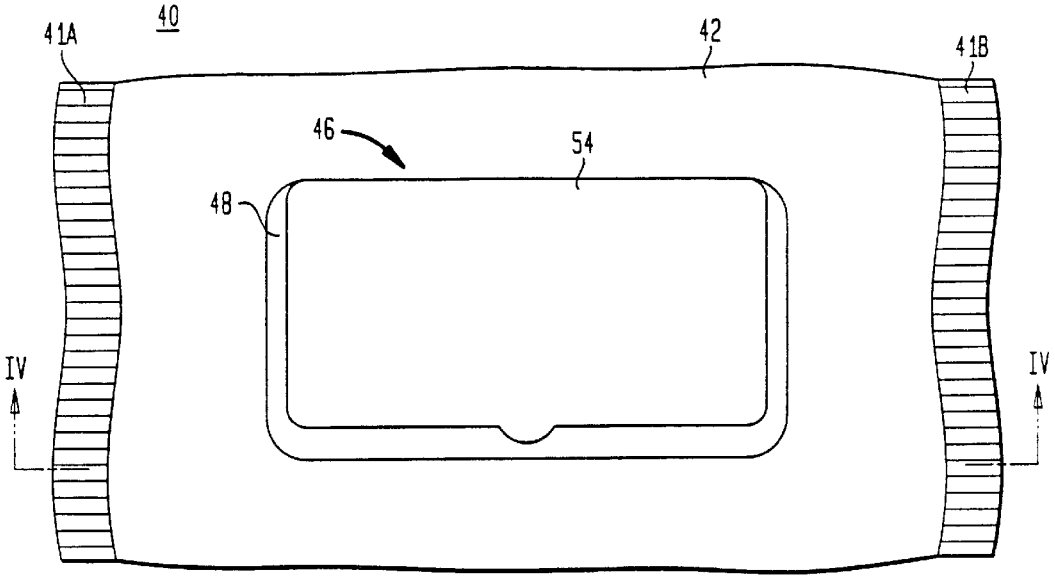
FIG. 3A shows a front elevation view of a dispenser package including a reclosable cover, in accordance with certain preferred embodiments of the present invention.
Figure 4A:
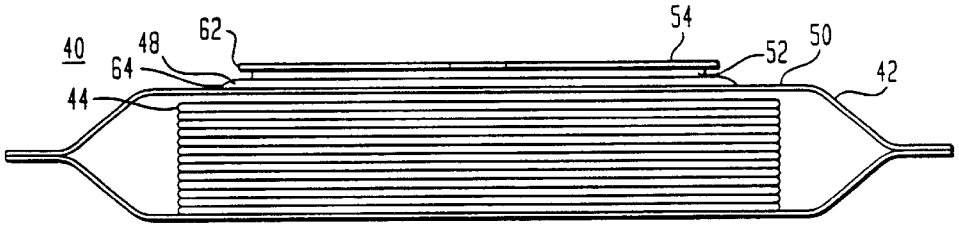
FIG. 4A shows a cross-sectional view of the dispenser package of FIG. 3 taken along line IV—IV of FIG. 3.
Figure 3B:
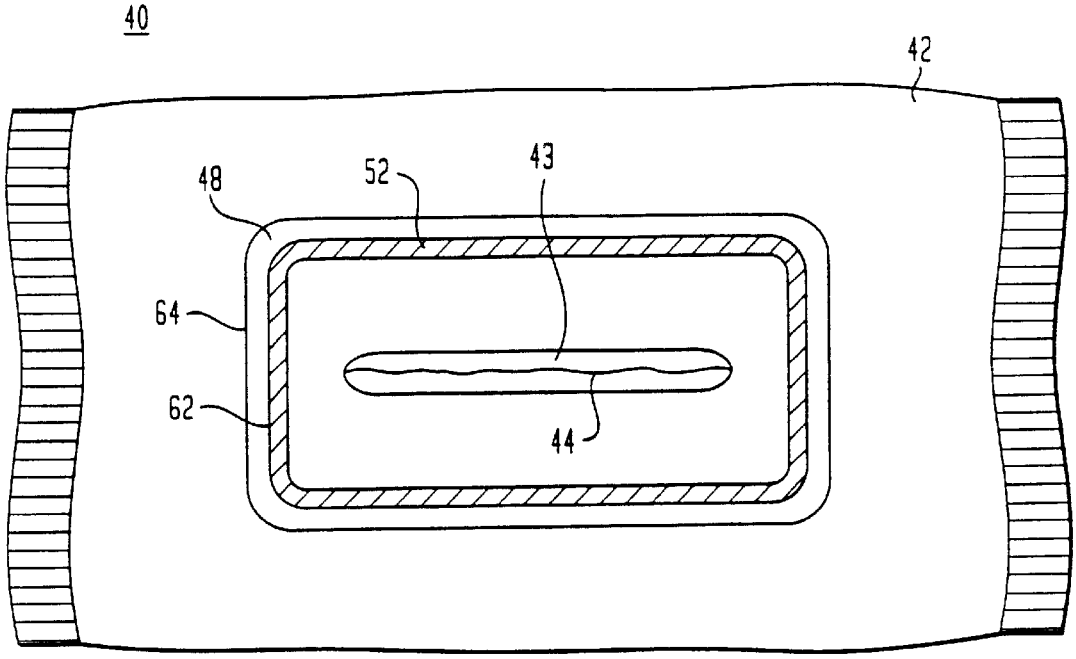
FIG. 3B shows a front elevation view of a dispenser package with the reclosable cover removed.

FIG. 3A shows show a dispenser package 40 for moistened items, such as towels. The dispenser package 40 is desirably formed of a single sheet of flexible material 42, such as a vinyl film, foil or any other flexible material which can be permanently sealed to provide a hermetically sealed container. The dispenser package 40 is preferably sealed at opposite ends 41A, 41B of the package. Referring to FIG. 3B, an area defining an opening 43 is formed in the flexible material, preferably before the package 40 is formed and sealed. The opening 43 is preferably of a sufficient size and shape to allow towels 44 to be pulled through the opening. The opening 43 may take the form of a circle, an oval, a slit or any other shape which will allow moistened towels to be dispensed from the package. Referring to FIGS. 3A and 4A, the opening 43 is preferably covered by a resealable cap assembly 46. The resealable cap assembly desirably includes a collar 48 that is attached to an exterior surface 50 of flexible material 42. As shown in FIG. 3B, collar 48 preferably completely surrounds the opening in the flexible material 42. Referring to FIG. 4A, collar 48 is preferably attached to the exterior surface 50 of the flexible material 42 using an ultrasonic seal, heat seal, glue seal, adhesive or epoxy such as a hot melt epoxy. The attachment between the collar and the flexible material may be resilient so that the collar 48 maintains a moisture-tight seal with the flexible material as the package flexes.

Figure 5:
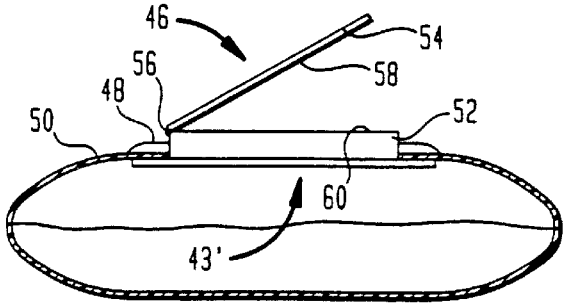
FIG. 5 shows a left side view of the dispenser package of FIG. 3 with the reclosable cover in an open position.

Referring to FIGS. 3B and 4A, collar 48 preferably includes a sealing flange 52 that projects away from the exterior surface 50 of the package and above the collar 48. The cap assembly 46 also desirably includes a reclosable cap 54 that may be opened for accessing towels at the package opening. Referring to FIG. 5, cap 54 may be hingedly connected to the sealing flange 52 by a hinge 56. The hinge 56 preferably comprises a resilient element, such as plastic, that allows the cap 54 to be repeatedly opened and closed. Referring to FIGS. 3B, 4A and 5, sealing flange 52 preferably has an outer perimeter 62 that lies within the outer perimeter 64 of collar 48. When the resealable cap 54 is in the closed position, an underside 58 of cap 54 preferably engages an upper surface 60 of sealing flange 52.

Figure 4B:
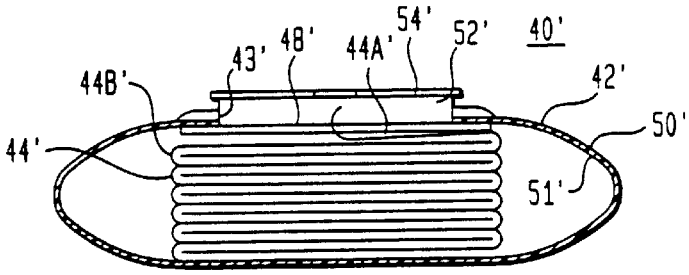
FIG. 4B shows a fragmentary cross-sectional view of a dispenser package, in accordance with further preferred embodiments of the present invention.

FIG. 4B shows a fragmentary view of a dispenser package 40' in accordance with other preferred embodiments of the present invention comprising flexible material 42' with exterior surface 50' and interior surface 51'. The flexible material 42' has an opening 43' extending between the interior and exterior surfaces 50', 51'. The package opening 43' is covered by resealable cap assembly 46' including collar 48', sealing flange 52' and reclosable cap 54'. The dispenser package 40' preferably has moistened towels 44' packed therein that are preferably interleaved with one another so that when a first towel 44A' is dispensed through the package opening 43', the leading edge of the next towel 44B' is accessible at the package opening 43'. In the particular embodiment shown in FIG. 4B, collar 48' is attached to an interior surface 51' of flexible material 42'. Sealing flange 52', which is integrally connected to collar 48', projects from collar 48' and through package opening 43'.

Figure 6:
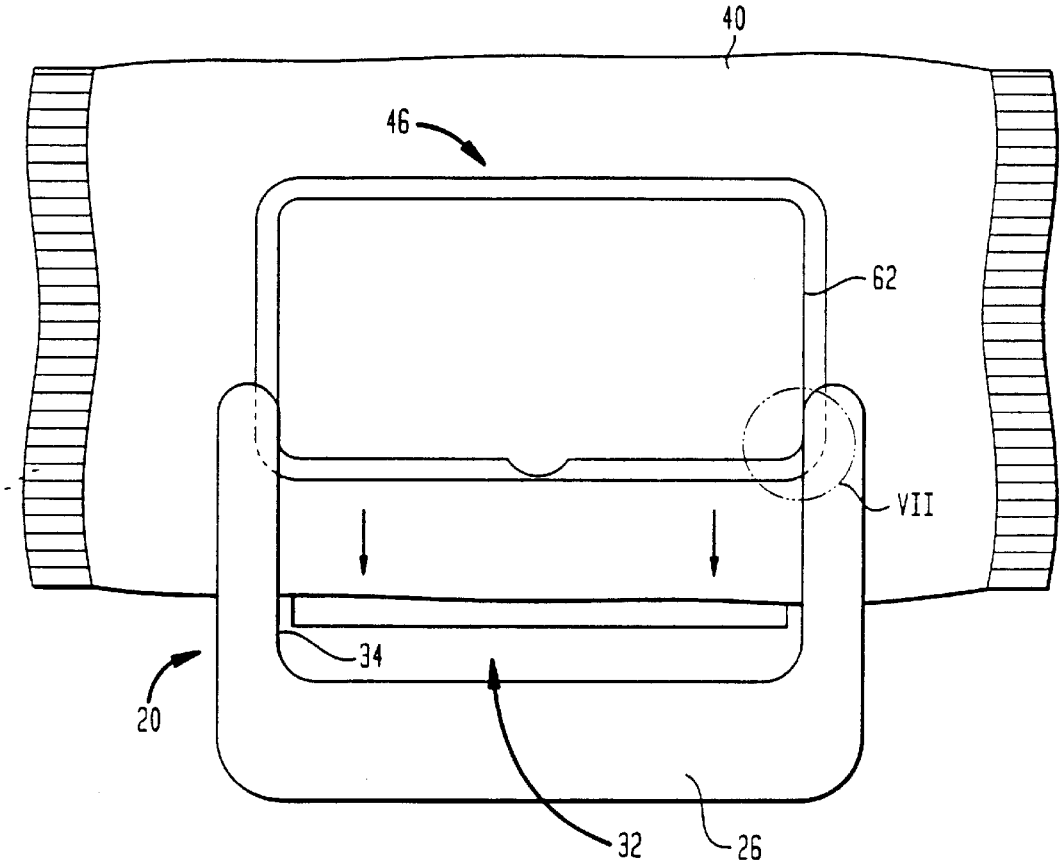
FIG. 6 shows the flexible dispenser package of FIG. 3 being partially inserted into the holder of FIGS. 1 and 2.
Figure 7:
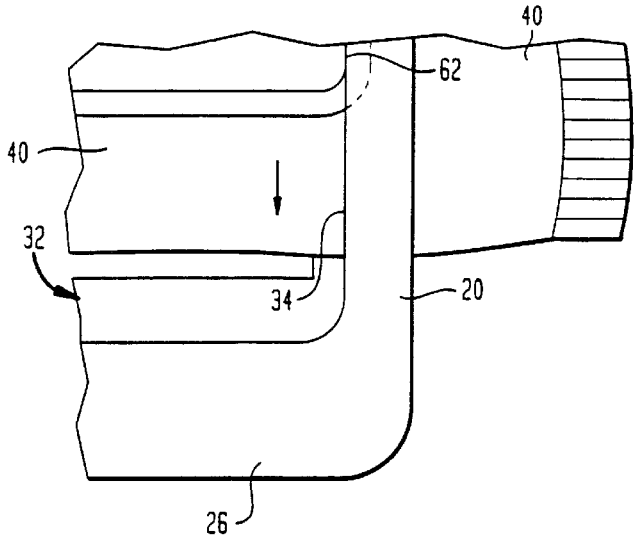
FIG. 7 shows an expanded fragmentary view of FIG. 6.

FIGS. 6 and 7 show the dispenser package 40 of FIGS. 3A and 4A secured to holder 20 of the FIGS. 1 and 2. The package is preferably secured to holder 20 by sliding resealable cap assembly 46 into engagement with the front wall aperture 32 of holder 20. As package 40 is slid into engagement with holder 20, the outer perimeter 62 of sealing flange 52 closely engages the interior edge 34 of front wall aperture 32, thereby securing dispenser package 40 to holder 20.

Figure 8:
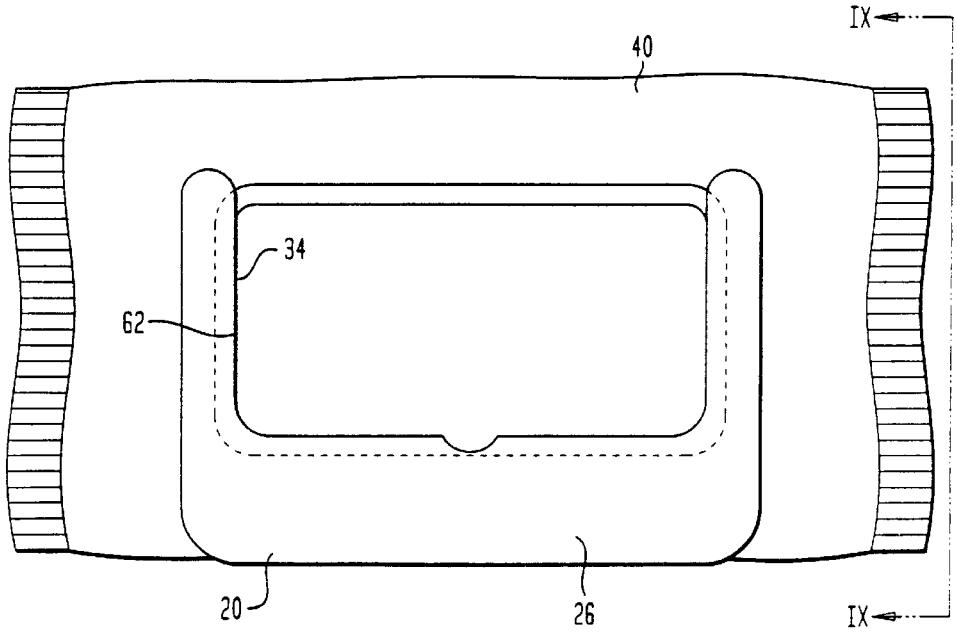
FIG. 8 shows the assembly of FIG. 6 with the dispenser package fully inserted into the holder of FIG. 1.
Figure 9:
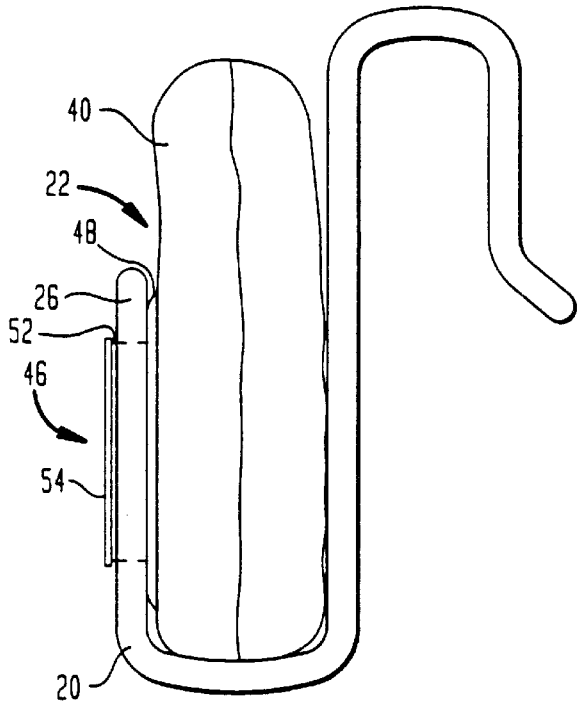
FIG. 9 shows a right side view of FIG. 8 taken along line IX—IX of FIG. 8.

FIGS. 8 and 9 show flexible package 40 after the package has been secured to holder 20, with the outer perimeter 62 of sealing flange 52 in close engagement with the interior edge 34 of front wall aperture 32. Referring to FIG. 9, reclosable cap 54 and a portion of sealing flange 52 project through the aperture in front wall 26. The collar 48 of reclosable cap assembly 46 engages an interior surface of front wall 26. Thus, the flexible dispenser package 40 is preferably secured to the holder 20 through the engagement of the outer perimeter 62 of sealing flange 52 with inner edge 34 of the aperture in front wall 26. Because the dispenser package 40 is secured to the holder by the engagement of the cap assembly with the front wall aperture, the flexible material of the dispenser package 40 is not pinched by holder 20. In addition, the package will not move away from the front wall aperture of the holder as towels are removed from the dispenser package.

Figure 10:
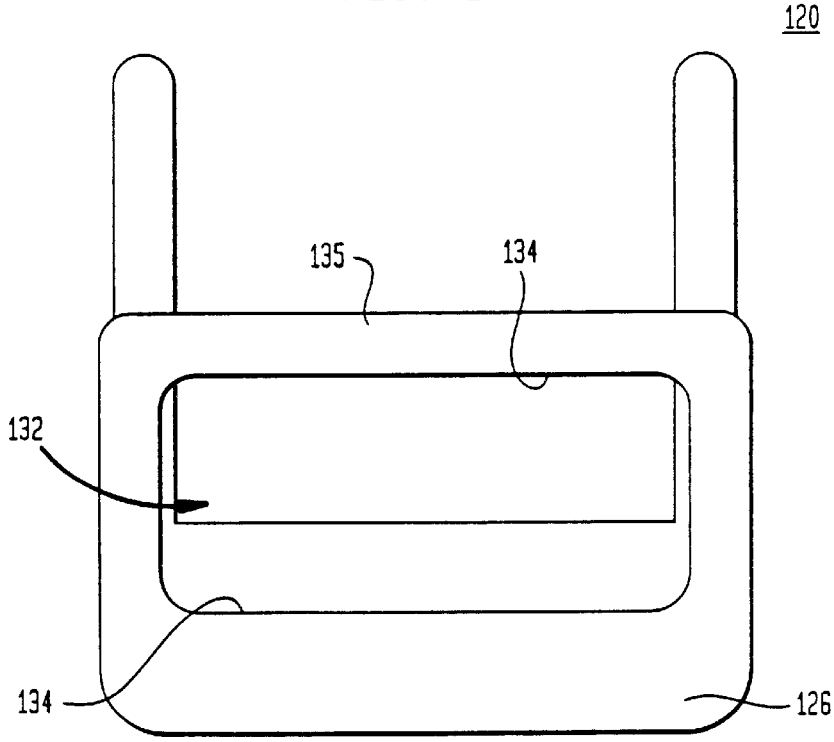
FIG. 10 shows a front elevational view of a holder for a dispenser package, in accordance with further preferred embodiments of the present invention.

FIG. 10 shows a holder 120 for a dispenser package that is substantially similar to that shown and described above. However, the front wall 126 of holder 120 includes a central aperture 132 that is bounded at its upper end by a connecting piece 135. Thus, the front wall aperture does not have an opening at an upper end thereof as provided in the preferred embodiment shown in FIG. 1. As a result, the entire outer periphery of central aperture 132 is bounded by inner peripheral edges 134 of front wall 126.

Figure 11:
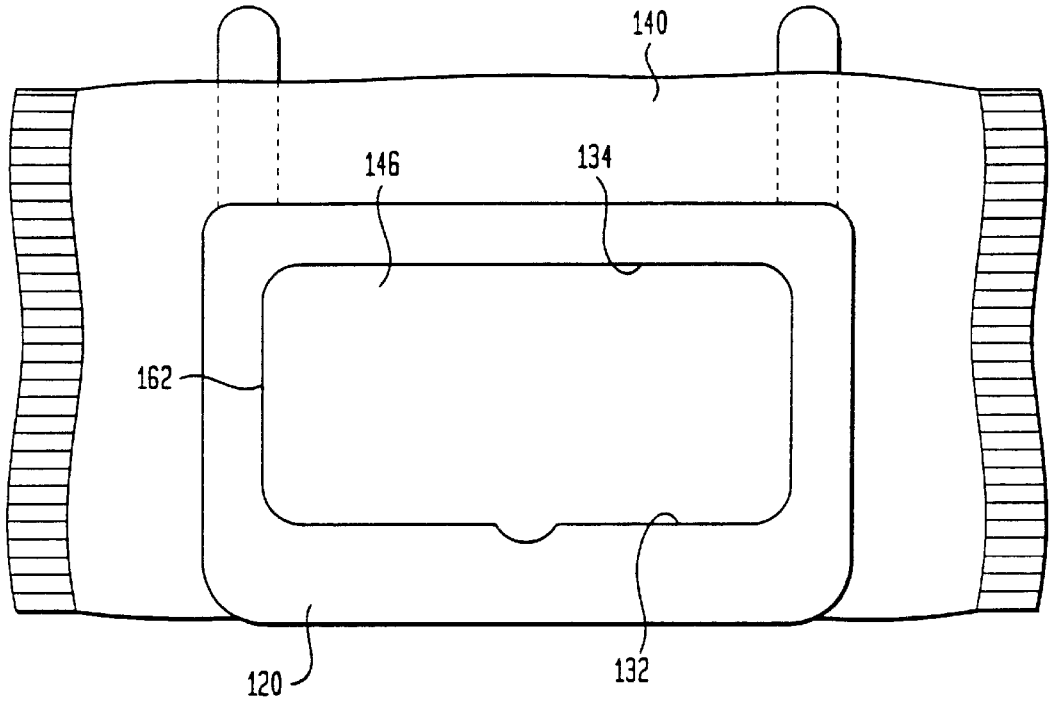
FIG. 11 shows the flexible dispenser package of FIG. 3 secured to the holder of FIG. 10.

Referring to FIG. 11, a dispenser package 140 may be secured to holder 120 of FIG. 10 by inserting a portion of resealable cap assembly 146 through central aperture 132. When the dispenser package 140 is secured in place, the outer peripheral surface 162 of sealing flange preferably engages the inner edges 134 of front wall aperture 126.

Figure 12:
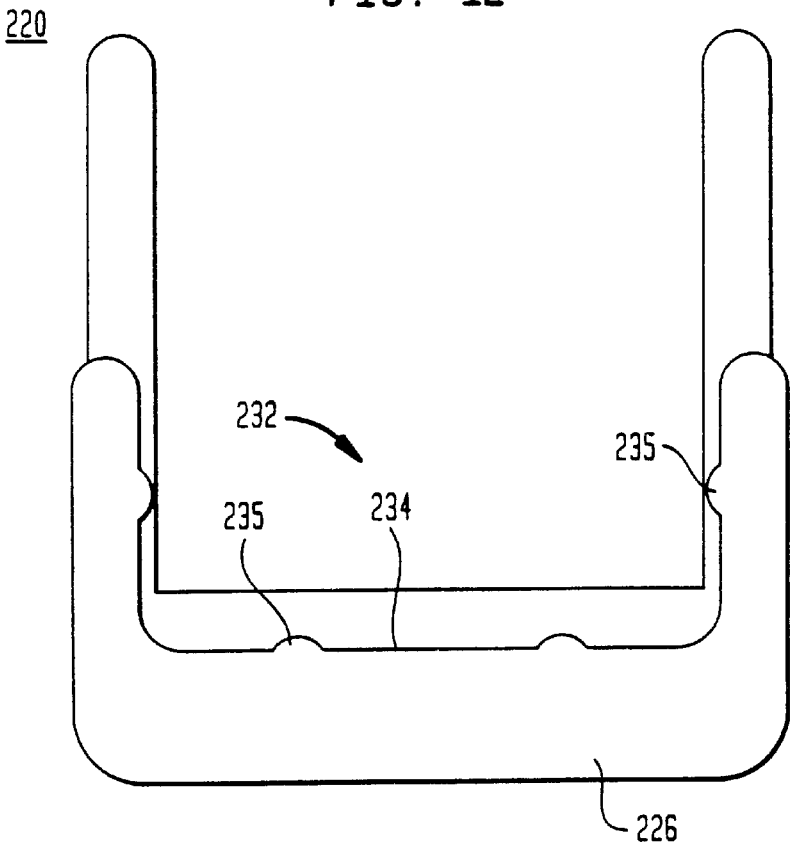
FIG. 12 shows a holder for a dispenser package, in accordance further preferred embodiments of the present invention.
Figure 13:
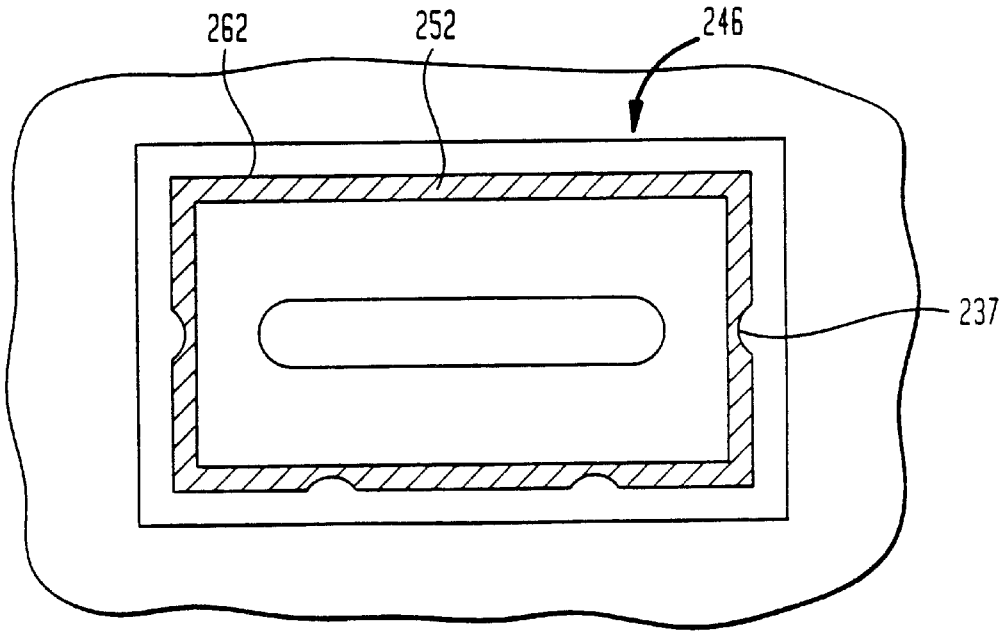
FIG. 13 shows a fragmentary view of a flexible dispenser package including the outer perimeter of a sealing flange.

FIGS. 12 and 13 show yet another preferred embodiment of the present invention wherein a holder 220 for a dispenser package includes a front wall 226 having an aperture 232 defined by one or more inner peripheral edges 234 of the front wall 226. The inner peripheral edges 234 of the front wall 226 may include one or more projections 235 extending into a central region of the aperture 232. Referring to FIG. 13, an outer perimeter 262 of sealing flange 252, includes one or more depressions 237 that are sized and shaped to engage the projections 235 at the peripheral edges of front wall aperture 232. As a result, when a dispenser package is secured to holder 220, the projections 235 mesh with the depressions of the sealing flange to secure the resealable cap assembly to the holder. In other preferred embodiments, the inner peripheral edges of the front wall aperture may include one or more depressions and the outer perimeter of the sealing flange of reclosable cap assembly may include one or more projections sized and shaped to closely mesh with the depressions for securing the dispenser package to the holder.

Figure 14:
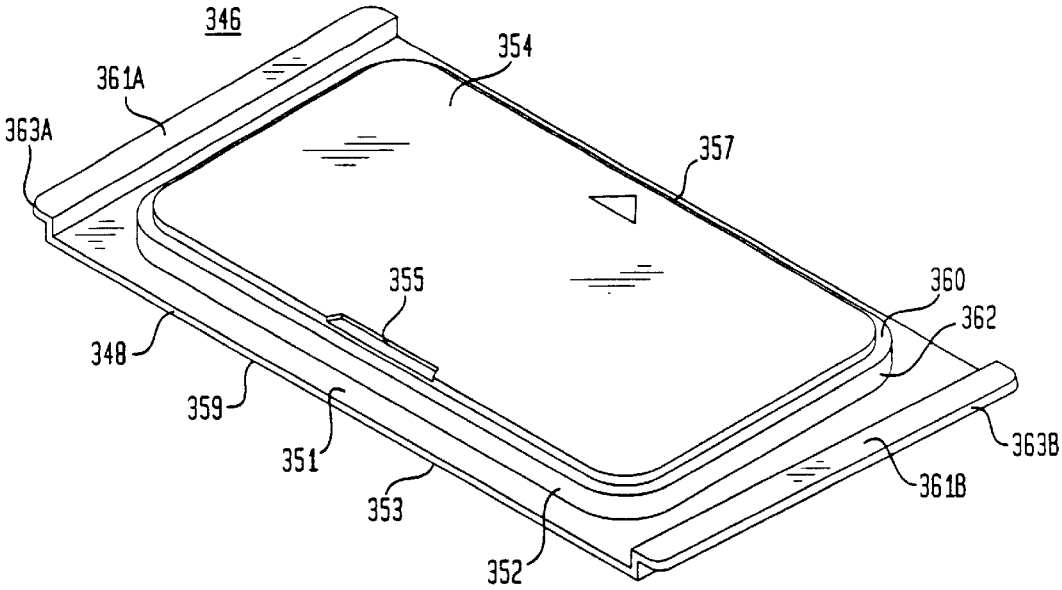
FIG. 14 shows a perspective view of a resealable cap assembly for a dispenser package, in accordance with further preferred embodiments of the present invention.

FIG. 14 shows a perspective view of a resealable cap assembly 346. The resealable cap assembly 346 preferably covers an opening in a sealed dispenser package, such as the dispenser package shown and described above. Resealable cap assembly 346 preferably includes collar 348 having top surface 351 and bottom surface 353 remote therefrom. The bottom surface 353 of collar 348 is preferably attached to an exterior surface of a flexible package, such as by using an adhesive or epoxy. Resealable cap assembly 320 includes sealing flange 352 having top surface 360 and outer perimeter 362. Resealable cap assembly 346 also includes lid 354 hingedly attached to sealing flange 352. A lower end of cap 354 includes notch 355 engagable for opening and closing cap 354.

Figure 15:
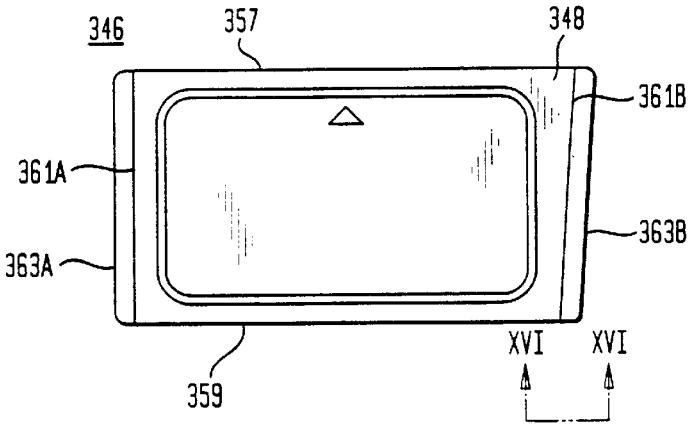
FIG. 15 shows a front view of the resealable cap assembly shown in FIG. 14.

Referring to FIGS. 14 and 15, resealable cap assembly 346 has an upper end 357, a lower end 359 and opposing sides 361A and 361B. Opposing sides 361A and 361B include attachment flanges 363A and 363B that extend between upper and lower ends 357, 359 of resealable cap assembly 346. The sides 361A, 361B of collar 348 taper inwardly from the upper end 357 to the lower end 359 thereof. In certain preferred embodiments, the sides taper inwardly at an angle $\alpha$ of between approximately 1–3°.

Figure 16:
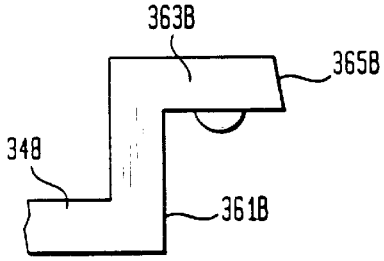
FIG. 16 shows a fragmentary view of the resealable cap assembly of FIG. 15 taken along line XVI—XVI of FIG. 15.

FIG. 16 shows a magnified view of side 361B of collar 348. Attachment flange 363B projects beyond the edge of collar 348. In certain preferred embodiments, flange 363B projects approximately 3–6 millimeters beyond the edge of collar 348. The outer edge 365B of flange 363B preferably tapers outwardly at an angle $\beta$ of approximately 4–6°.

Figure 17:
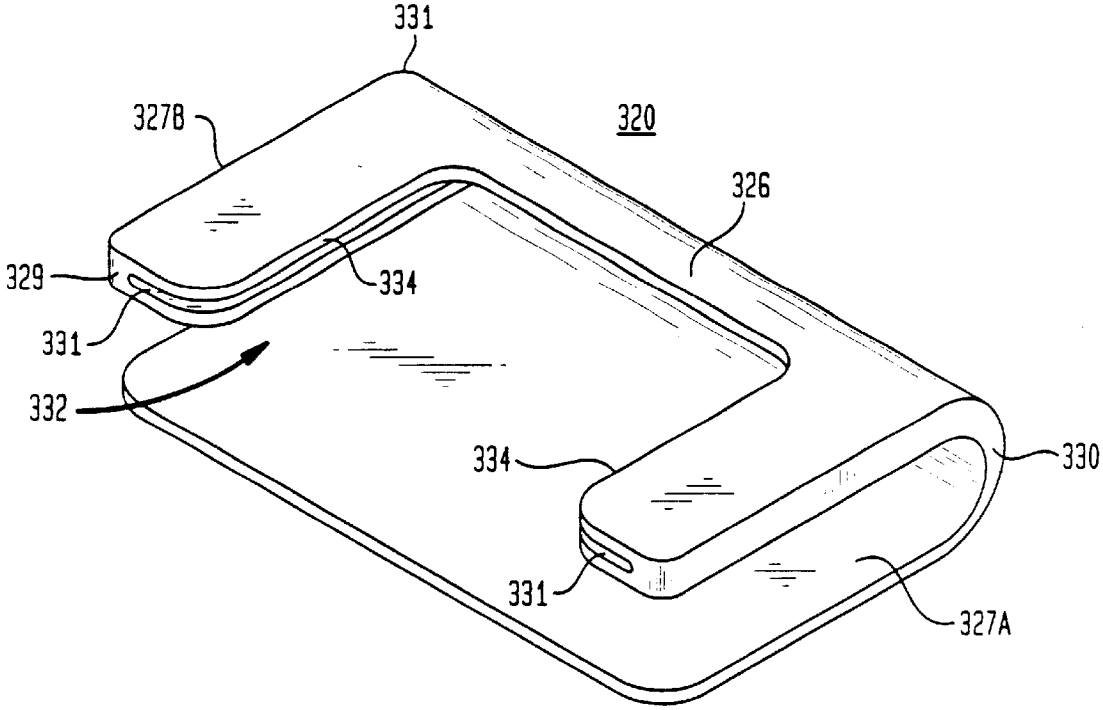
FIG. 17 shows a perspective view of a holder for the resealable cap assembly of FIG. 14, in accordance with certain preferred embodiments of the present invention.

FIG. 17 shows a holder 320 for a dispenser package, in accordance with further preferred embodiments of the present invention. Holder 320 preferably comprises a resilient material, such as a polymer, plastic or metal. Holder 320 includes front wall 326, rear wall 328 and bottom wall 330 interconnecting lower ends of front wall 326 and rear wall 328. Front wall 326 includes upper end 329 and lower end 331. Front wall 326 also includes outer peripheral edges 327A and 327B. Front wall 326 has an aperture 332 formed therein that is positioned inwardly from the outer peripheral edges 327A, 327B. Aperture 332 is defined by inner peripheral edges 334 positioned inwardly of outer peripheral edges 327A, 327B. Inner peripheral edges 334 preferably include grooves 331 extending from the upper end 329 toward the lower end 331 of front wall 326. The grooves preferably extend from inner edge 334 toward outer peripheral edge 327. The grooves may have a substantially U-shaped base.

Referring to FIGS. 14–17, after recloseable cap assembly 346 has been attached to a dispenser package, the dispenser package may be secured to the holder 320. In certain preferred embodiments, the dispenser package is secured to holder 320 by sliding attachment flanges 361A, 361B into the grooves 333 of front wall 326 aperture 332. After the dispenser package has been secured in place, the sealing flange 352 and recloseable cap 354 preferably extend through aperture 332 so that the cap 354 may be readily opened and closed.

Figure 18:
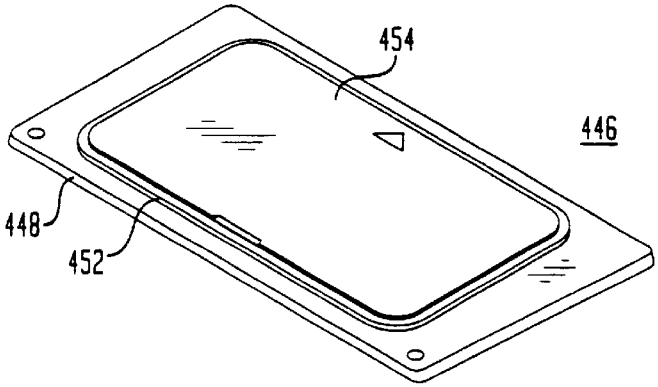
FIG. 18 shows a perspective view of a resealable cap assembly for a dispenser package, in accordance with still further preferred embodiments of the present invention.
Figure 20:
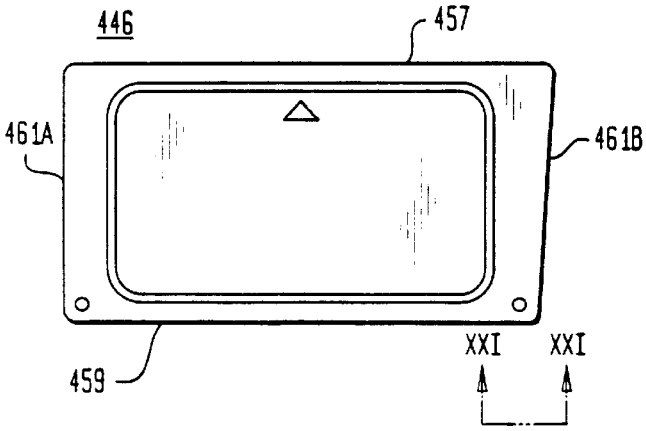
FIG. 20 shows a front view of the resealable cap assembly of FIG. 18.
Figure 21:
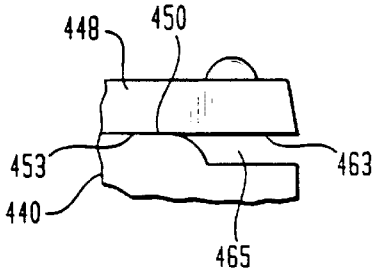
FIG. 21 shows a fragmentary view of the resealable cap assembly of FIG. 20 taken along line XXI—XXI of FIG. 20.

FIG. 18 shows a resealable cap assembly 446 in accordance with further preferred embodiments of the present invention. Resealable cap assembly 446 includes collar 448 attachable to an exterior surface of a dispenser package. Resealable cap assembly also includes sealing flange 452 integrally connected with collar 448 and recloseable cap 454 hingedly connected to sealing flange 452. Referring to FIGS. 18, 20 and 21, resealable cap assembly 446 has upper end 457, lower end 459 and sides 461A, 461B extending between upper and lower ends 457, 459. Referring to FIG. 20, sides 461A, 461B preferably taper inwardly from the upper end 457 to the lower end 459 of cap assembly 446 at an angle $\alpha'$ of approximately 1–3°.

Referring to FIG. 21, an underside 453 of collar 448 is preferably adhered to exterior surface 450 of dispenser package 440, such as by using an adhesive or epoxy. However, the outermost edge 463 of collar 448 is not adhered to exterior surface 450 of package 440. As a result, a gap 465 may form adjacent edge 463 and exterior surface 450 of package 440. The outer peripheral edge 463 of collar 448 preferably tapers outwardly at an angle designated $\beta'$ of approximately 4–6°.

Figure 19:
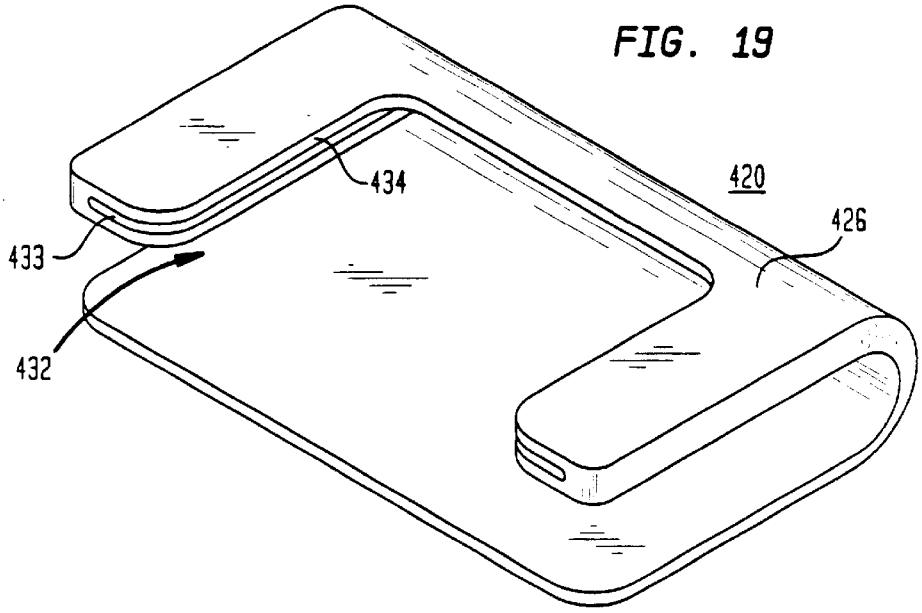
FIG. 19 shows a perspective view of a holder for the resealable cap assembly of FIG. 18, in accordance with certain preferred embodiments of the present invention.

After the resealable cap assembly 446 of FIG. 18 has been attached to an exterior surface of a dispenser package, the dispenser package may be secured to the holder 420 of FIG. 19 by sliding collar 448 into the grooves 433 of front wall aperture 432. After resealable cap assembly has been secured within grooves 433, sealing flange 452 and recloseable cap 454 preferably project through aperture 432. As a result, recloseable cap 454 may be repeatedly opened and closed for dispensing towels through an opening in a dispenser package.

Figure 22:
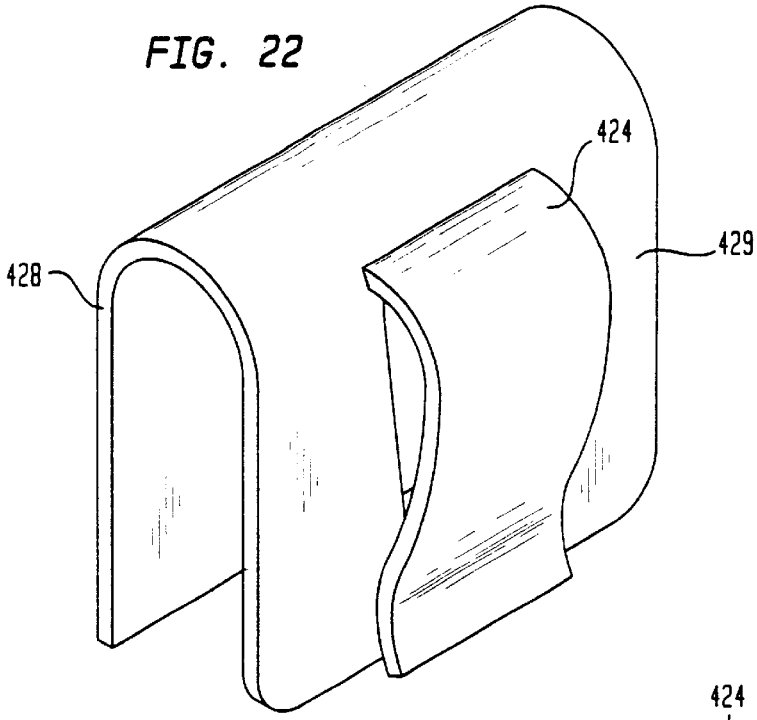
FIG. 22 shows a rear view of a clip for the holder shown in FIGS. 17 and 19, in accordance with certain preferred embodiments of the present invention.
Figure 23:
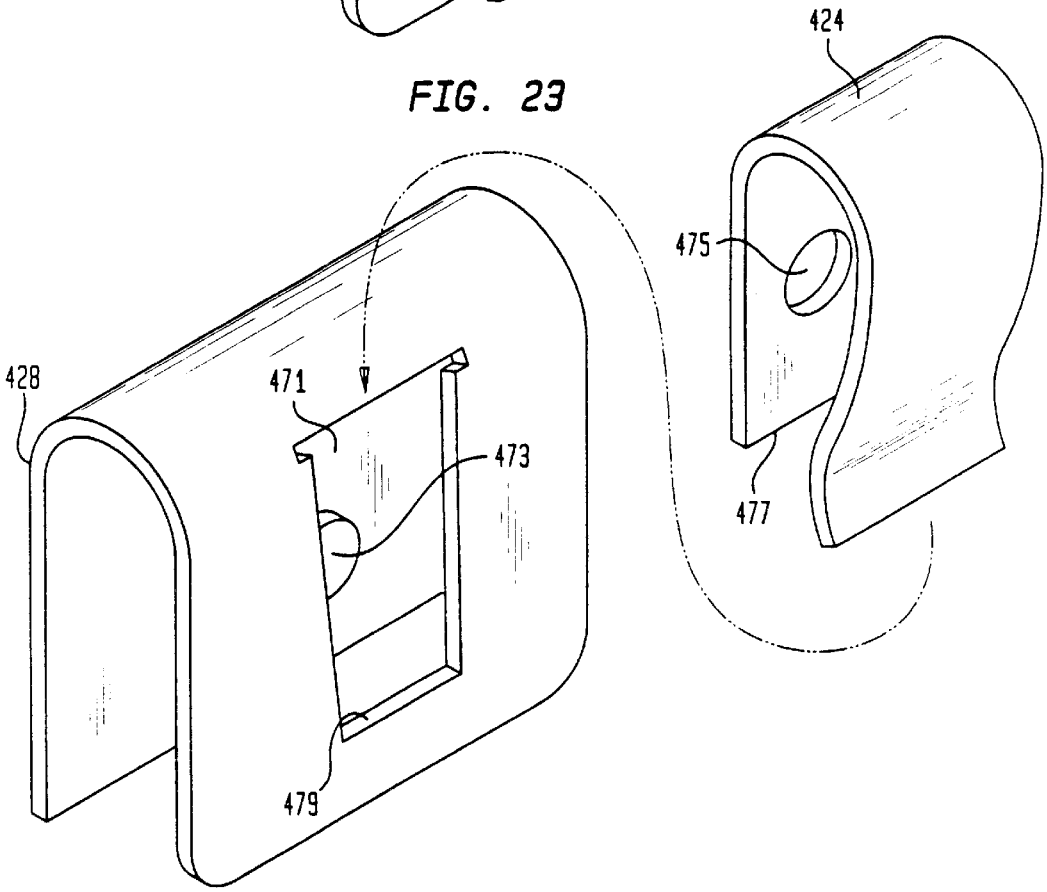
FIG. 23 shows a perspective view of the clip of FIG. 22 disassembled from the holder.

FIGS. 22 and 23 show a clip 424 that may be attached to a rear wall 428 of holders 320, 420 shown in respective FIGS. 17 and 19. Rear wall 428 includes an integrally molded extension 429 including slot 471 having bump 473. Clip 424 includes aperture 475 formed therein that is sized and shaped to receive bump 473. In order to assemble clip 424 to rear wall 428, clip 424 is slid into slot 471 until lower end 477 of clip 424 engages lower end 479 of slot 471 and bump 473 engages aperture 475. Clip 424 preferably comprises a resilient material such as plastic or metal. In operation, clip 424 enables holder 420 to be secured to an edge of a surface such as a sun visor, a table top, a belt or an apron.

Figure 24:
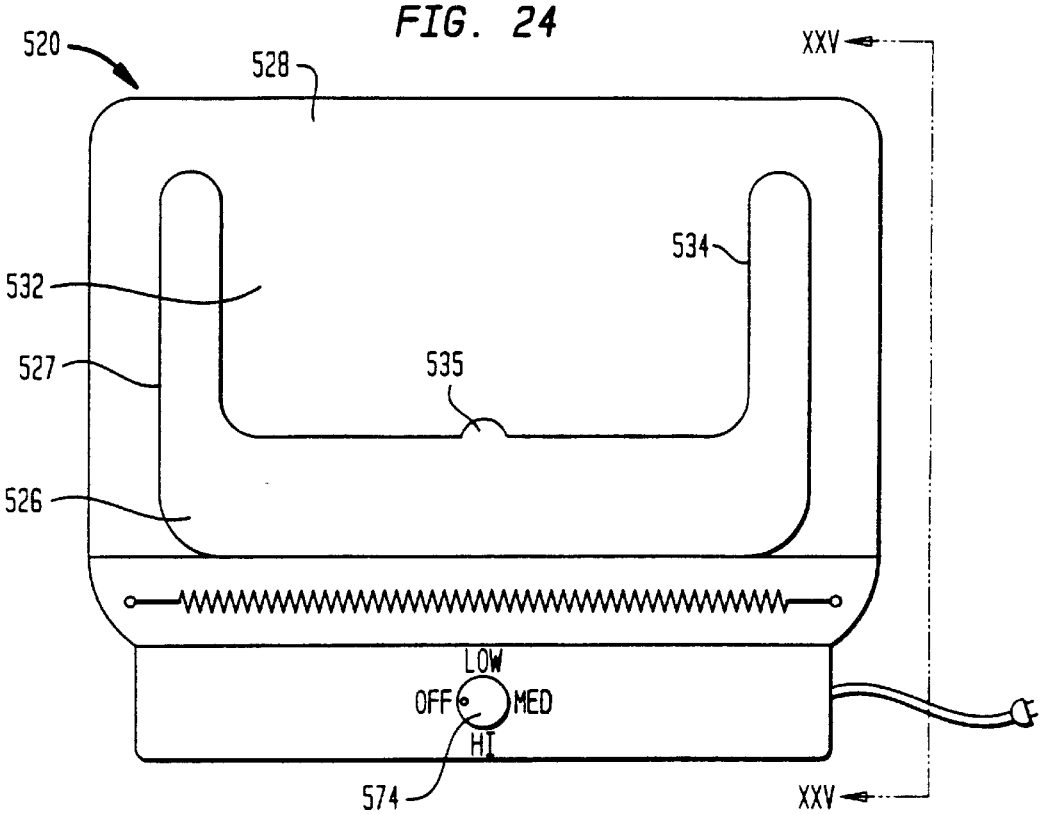
FIG. 24 shows a front elevational view of a holder and heating unit for a dispenser package, in accordance with yet further preferred embodiments of the present invention.
Figure 25:
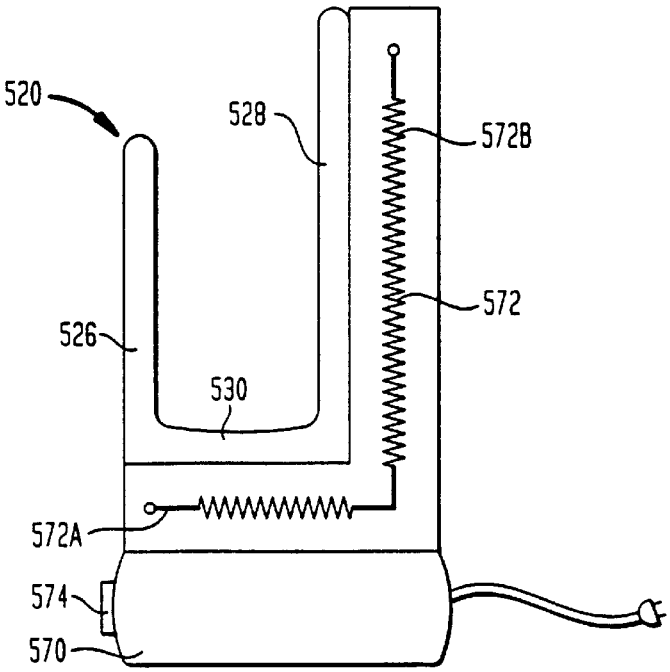
FIG. 25 shows a right side view of the holder of FIG. 24 taken along line XXV—XXV of FIG. 24.

FIGS. 24 and 25 show still another preferred embodiment of the present invention including a combination holder and heating assembly. The holder 520 preferably includes front wall 526 having outer peripheral edges 527. The front wall includes an aperture 532 spaced inwardly from the outer peripheral edges 527 thereof. The aperture 532 is defined by inner peripheral edges 534 that are spaced inwardly from the outer peripheral edges 527 of the front wall. The inner peripheral edges 534 of the front wall aperture 532 also preferably include at least one actuating element 535. The actuating element 535 is preferably adapted to engage a portion of the reclosable cap assembly of a dispenser package when the reclosable cap assembly is inserted into the aperture 532. Referring to FIG. 25, the holder 520 also preferably includes rear wall and bottom wall 530 that interconnects lower ends of rear wall 528 and front wall 526.

Referring to FIGS. 24 and 25, the combination also preferably includes base 570 having one or more heating coils 572. The holder 520 may be attached to the base 570 so that one or more walls of the holder are closely spaced with heating coils 572. In the specific embodiment shown in FIG. 25, a first heating coil 572A extends in close engagement with bottom wall 530 and a second heating coil 572B extends in close engagement with rear wall 528 of holder 520. The base 570 preferably includes a control element 574, such as a rotatable knob, for activating and deactivating the heating unit and adjusting the amount of heat generated by the heating coils. In preferred embodiments, the heating coils 572 will operate only after the control element 574 has been set at one of the temperature preferences and after the actuating element 535 has been engaged by the reclosable cap assembly. The heating assembly will be deactivated if the flexible dispenser package is removed from the holder or if the control element is switched to the off position.

Figure 26:
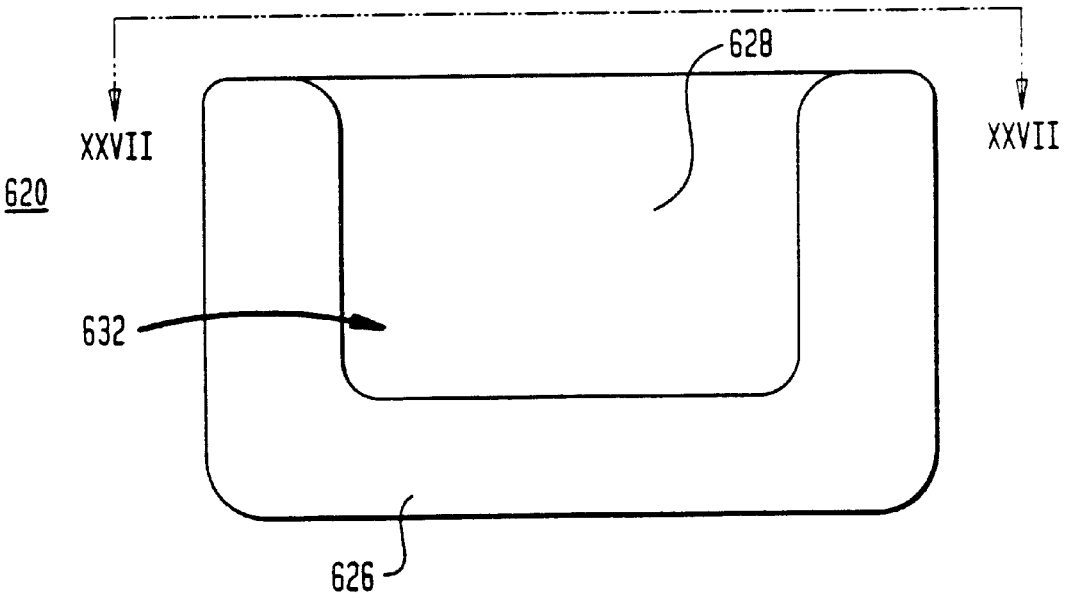
FIG. 26 shows a front elevational view of a holder for a dispenser package, in accordance with further preferred embodiments of the present invention.
Figure 27:
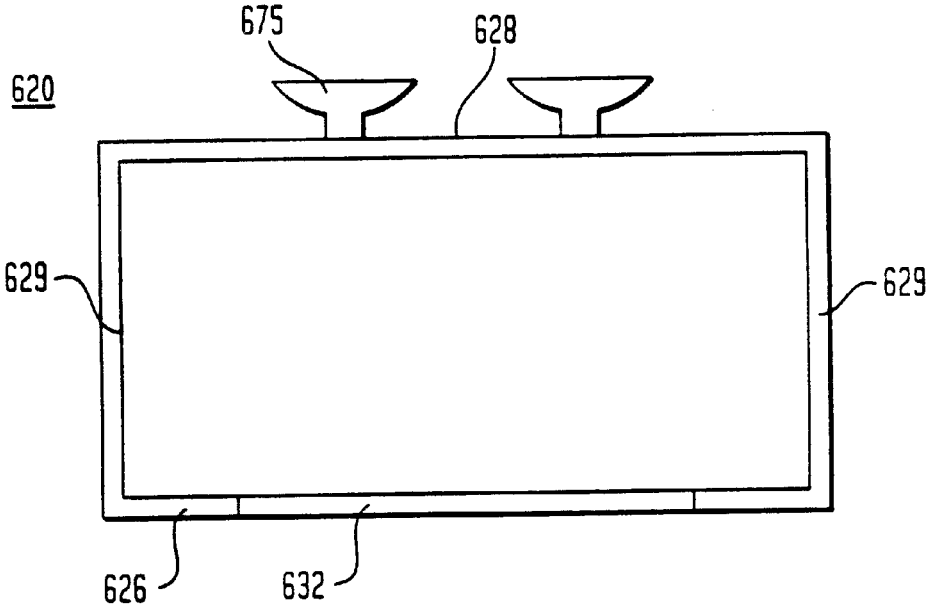
FIG. 27 shows a top view of the holder of FIG. 26 taken along line XXVII—XXVII of FIG. 26.

FIGS. 26 and 27 show another preferred embodiment of the present invention including a holder 620 having front wall 626, front wall aperture 632, rear wall 628 and one or more side walls 629 extending between the front and rear walls. The side walls 629 preferably enclose the ends of the holder and cover the sealed ends of the package. The side walls may include the heating elements shown and described above in FIGS. 24 and 25. The holder 620 may have one or more suction cups 675 attached thereto for attaching the holder to a surface. In the particular preferred embodiment shown in FIG. 27, the suction cups 675 are attached to the rear wall 628 of holder 620. In other embodiments, the suction cups may be attached to any exterior surface of the holder.

Figure 28:
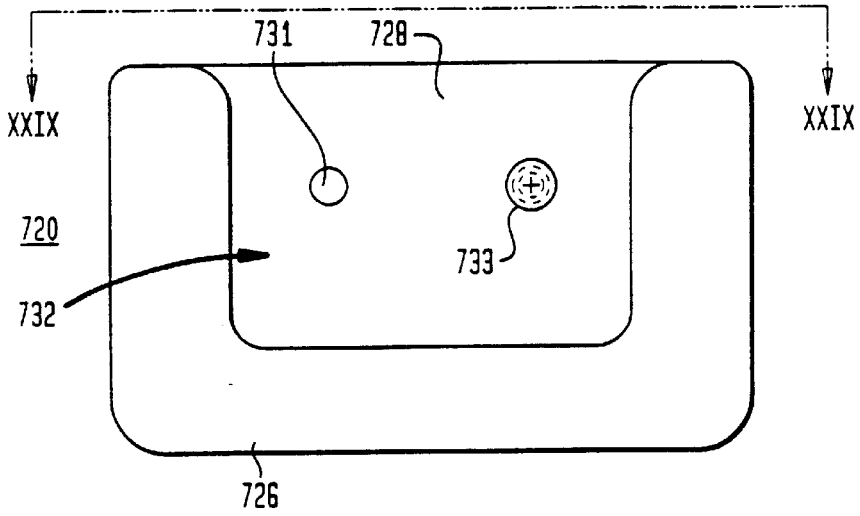
FIG. 28 shows a front elevational view of a holder for a dispenser package, in accordance with still further preferred embodiments of the present invention.
Figure 29:
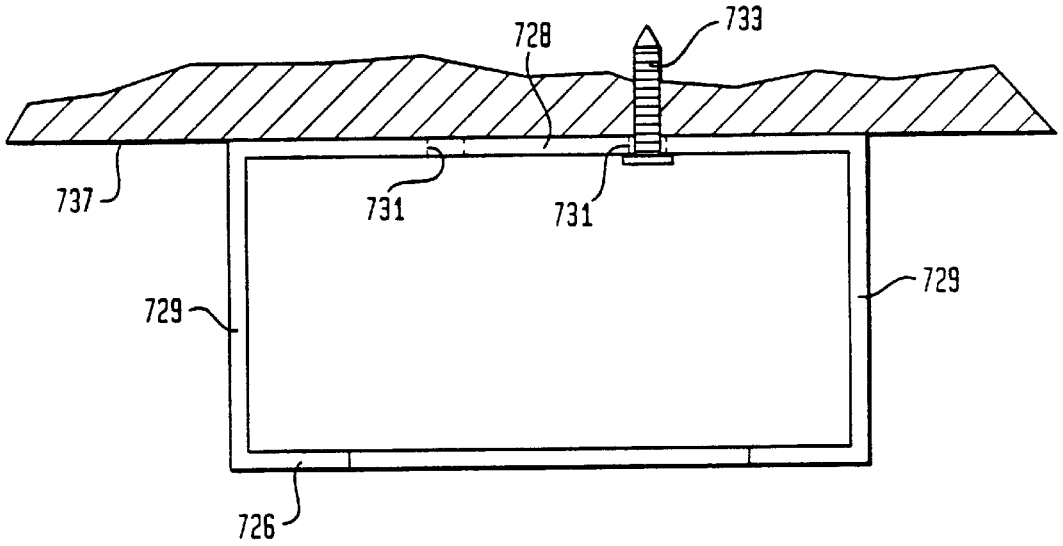
FIG. 29 shows a top view of the holder of FIG. 28 taken along line XXIX—XXIX of FIG. 28.

FIGS. 28 and 29 show a holder 720 in accordance with still another preferred embodiment of the present invention including front wall 726 having front wall aperture 732, rear wall 728, and side walls 729 extending between front and rear walls. Rear wall 728 preferably includes one or more openings 731 sized and shaped to receive one or more fasteners 733, such as a screw. The fasteners 733 are preferably passed through the openings in the rear wall and secured to a surface 737, such as a wall or table top. In other preferred embodiments, the fastener openings may extend through the side walls or bottom wall of the holder.

Figure 30:
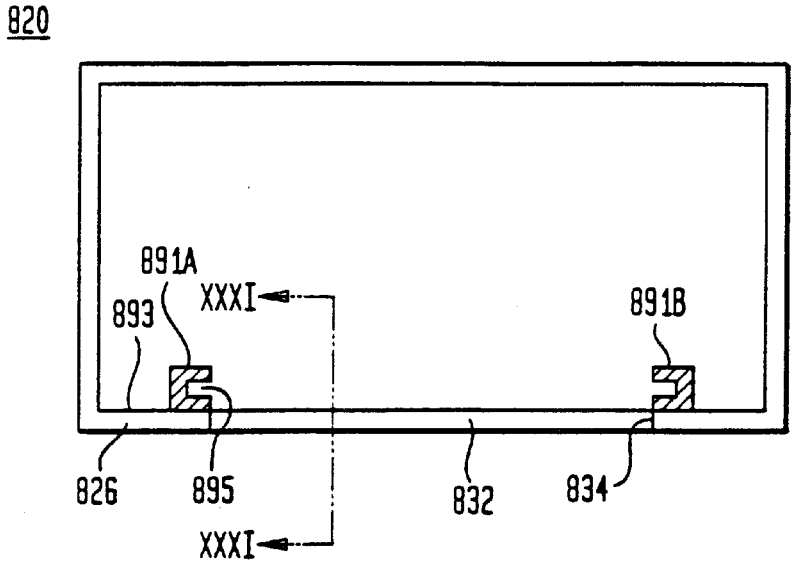
FIG. 30 shows a top view of a holder, in accordance with further preferred embodiments of the present invention.
Figure 31:
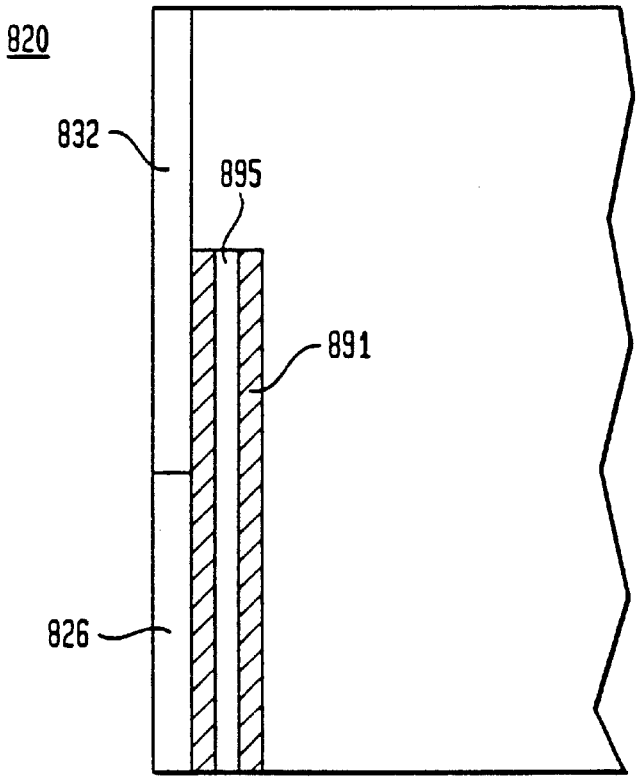
FIG. 31 shows a fragmentary view of the holder of FIG. 30 taken along line XXXI—XXXI of FIG. 30.

FIGS. 30 and 31 show a holder 820 in accordance with another preferred embodiment of the present invention wherein front wall 826 includes one or more elongated members 891 that are attached to an interior surface 893 of front wall 826. Each elongated member 891 has a groove 895 or slot that is adapted for receiving an edge or projecting flange of a resealable cap assembly (not shown) so that a dispenser package may be secured to holder 820. The elongated members 891 may be attached to or integrally connected with front wall 826. In the particular embodiment shown, opposing elongated members 891A, 891B are attached adjacent the inner peripheral edges 834 surrounding front wall aperture 832. The grooves 895 of the elongated members 891A, 891B preferably oppose one another for receiving outer edges of the resealable cap assembly.

Figure 32:
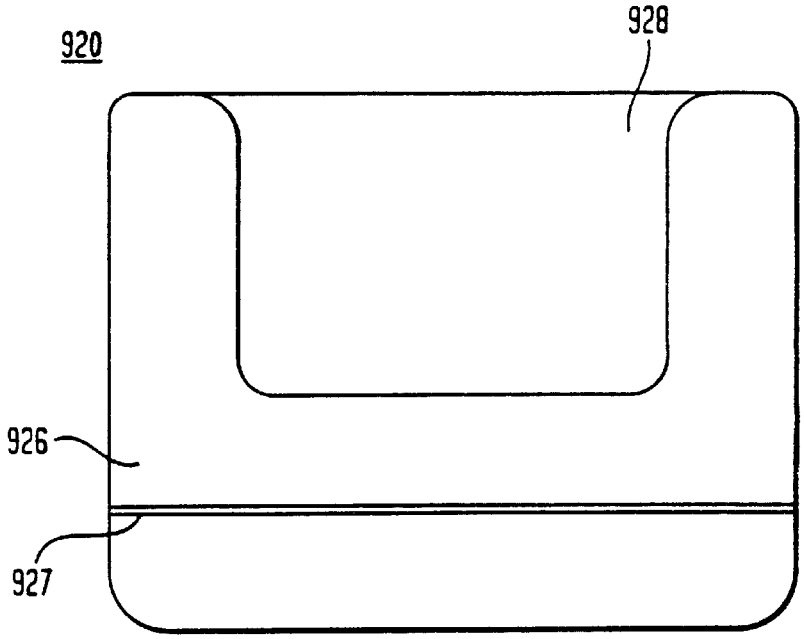
FIG. 32 shows a front view of a holder, in accordance with further preferred embodiments of the present invention.
Figure 33:
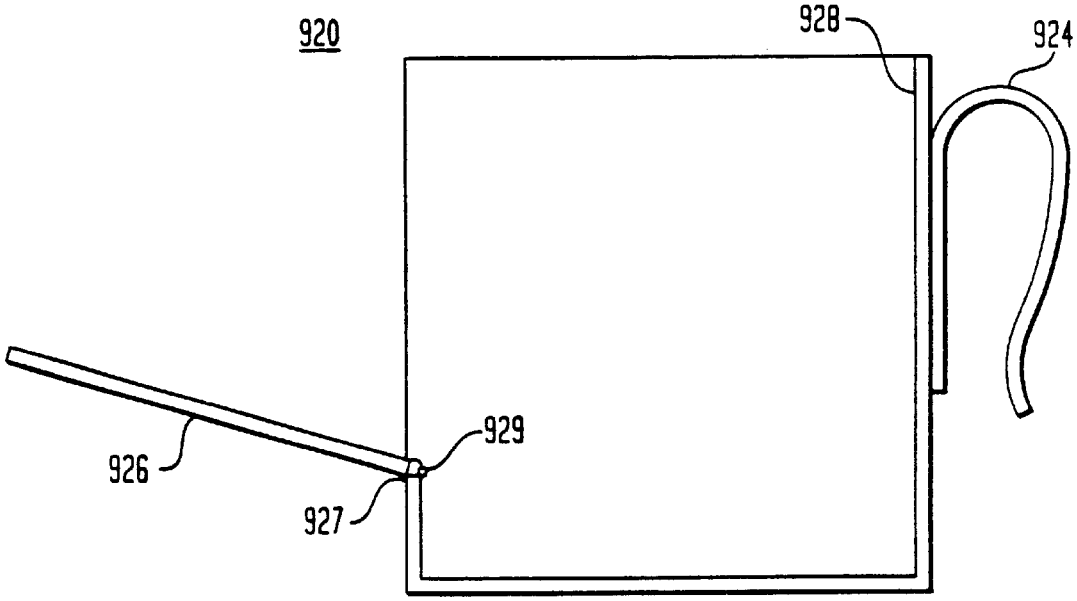
FIG. 33 shows a fragmentary side view of the holder of FIG. 32 taken along line XXXIII—XXXIII of FIG. 32, with a front wall of the holder swung to an open position.

FIGS. 32 and 33 a holder 920 in accordance with another preferred embodiment of the present invention wherein front wall 926 includes a hinge 927 so that front wall is movable between open and closed positions for easily loading and/or removing a dispenser package from a holder. FIG. 32 shows front wall 926 of holder 920 in a closed position. However, the front wall 926 can be swung about hinge 927 to the open position shown in FIG. 33. In the open position, a dispenser package may be easily loaded into the holder. After a dispenser package has been placed in the holder 920, the front wall 926 may be swung back to the closed position shown in FIG. 32. Referring to FIG. 33, in certain preferred embodiments, the holder also includes a resilient element 929 adjacent hinge 927 that normally urges the front wall 926 to move back to the closed position. As a result, an operator can merely release the front wall 926 when the front wall is in the opened position and the front wall will snap back to the closed position.

Although the present invention has been described with reference to particular preferred embodiments, it is to be understood that the embodiments merely illustrate certain principles and applications of the present invention. It is therefore to be understood that numerous modifications may be made to the preferred embodiments and that other arrangements may be devised without departing from the spirit and scope of the present invention as defined by the claims.

What is claimed is:

1. A holder for a dispenser package having a resealable cap assembly with an outer perimeter, said holder comprising:

a front wall, a rear wall and an bottom wall interconnecting lower ends of said front and rear walls, said front, rear and bottom walls defining a receiving area for said dispenser package, said front wall including an aperture defined by inner peripheral edges of said front wall;

a heating element in thermal communication with at least one of said front, rear and bottom walls;

a power source connected with said heating element; and at least one actuator provided at the inner peripheral edges of said front wall aperture, said at least one actuator being in communication with said heating element, said at least one actuator being movable between a first position for activating said heating element and a second position for deactivating said heating element.

2. The holder as claimed in claim 1, wherein an outer peripheral surface of said resealable cap assembly is engagable with the inner peripheral edges of said front wall aperture for securing said dispenser package to said holder.

3. A holder for a dispenser package having a resealable cap assembly with an outer perimeter, said holder comprising:

a front wall, a rear wall and a bottom wall interconnecting lower ends of said front and rear walls, said front, rear and bottom walls defining a receiving area for said dispenser package, said front wall including an aperture defined by inner peripheral edges of said front wall;

a heating element in thermal communication with at least one of said front, rear and bottom walls; and at least one actuator provided at the inner peripheral edges of said front wall aperture, said at least one actuator being in communication with said heating element, said at least one actuator being movable between a first position for activating said heating element and a second position for deactivating said heating element, wherein the outer perimeter of said resealable cap is engagable with said at least one actuator for moving said at least one actuator into the first position so as to activate said heating element.

4. The holder as claimed in claim 3, wherein said heating element includes one or more heating coils in thermal communication with at least one of said front, rear and bottom walls.

5. The holder as claimed in claim 4, wherein said heating element includes a control device for adjusting a heating level of said heating element.

6. The holder as claimed in claim 3, wherein at least a portion of said heating element is provided in a base unit, and wherein said holder is mounted atop said base unit.

7. The holder as claimed in claim 3, wherein said dispenser package comprises:

a hermetically sealed package having an opening for dispensing one or more items from said package;

said resealable cap assembly covering the opening of said package, said resealable cap assembly including a sealing flange and a reclosable cap engagable with said sealing flange.

8. The holder as claimed in claim 7, wherein said reclosable cap is hingedly connected with said sealing flange.

9. The holder as claimed in claim 7, wherein said dispenser package comprises a flexible material having a seal around one or more edges thereof.

* * * * *